US005285729A

United States Patent [19]

Bangtsson et al.

[11] Patent Number: 5,285,729

[45] Date of Patent: Feb. 15, 1994

[54] INDICATION OF SNOW PACKING FOR RAILWAY VEHICLES

[75] Inventors: Hans Bangtsson, Enkoping; Nils G. Nilstam; Rickard Persson, both of Västeras, all of Sweden

[73] Assignee: ASEA Brown Boveri AB, Västeras, Sweden

[21] Appl. No.: 989,490

[22] Filed: Dec. 10, 1992

Related U.S. Application Data

[63] Continuation-in-part of Ser. No. 776,326, Dec. 12, 1991, abandoned.

[30] Foreign Application Priority Data

Jul. 13, 1989 [SE] Sweden ..... 8902526

[51] Int. Cl.[5] ..... B61F 5/02

[52] U.S. Cl. ..... 105/199.2

[58] Field of Search ..... 105/199.1, 199.2, 453, 105/164

[56] References Cited

U.S. PATENT DOCUMENTS 3,688,703 9/1972 Pollinger ..... 105/199.2
3,789,769 2/1974 Strohmer et al. ..... 105/199.2
3,844,225 10/1974 Majo .
3,869,910 3/1975 Scaletta .
3,970,009 7/1976 Schultz ..... 105/199.2
4,091,738 5/1978 Platner ..... 105/199.1
4,355,582 10/1982 Germer ..... 105/199.2

FOREIGN PATENT DOCUMENTS 381012 11/1975 Sweden .

*Primary Examiner*—Mark T. Le
*Attorney, Agent, or Firm*—Watson, Cole, Grindle & Watson

[57] ABSTRACT

The invention relates to a method for tilting of the car body in track curves on a railbound vehicle, the tilting of the car body being achieved by means of hydraulic cylinders and the tilting being adapted to be controlled by one or more servo functions. According to the invention, the car body tilt is adapted to be limited to a maximum value, and when snow occurs, which is packed between the different parts of the tilting system, the degree of snow packing is indicated, and when a certain degree of snow packing is exceeded, the desired value of the tilt angle is maximized to a suitable smaller value.

4 Claims, 4 Drawing Sheets

INDICATION OF SNOW PACKING FOR RAILWAY VEHICLES

CROSS-REFERENCE TO RELATED APPLICATION

This application is a continuation-in-part of application Ser. No. 776,326, filed Dec. 12, 1991, now abandoned, which derived from PCT/SE90/00469, filed Jun. 29, 1990.

TECHNICAL FIELD

The present invention relates to a method for tilting of the car body in track curves on a railbound vehicle, the tilting of the car body being achieved by means of hydraulic cylinders, and the tilting being adapted to be controlled by one or more servo functions.

BACKGROUND ART

One example of an arrangement for tilting of the car body is disclosed in Swedish patent application 8902526-6, in which the hydraulic cylinders are arranged mutually communicating and the tilting of the car body is adapted to be controlled by a servo function comprising one servo function per vehicle.

In a vehicle with tilting of the car body, for example as described above, the desired value of the tilting is normally formed with the aid of the lateral acceleration. To avoid a great tilting movement, this is often limited to a maximum value. Under winter conditions, snow which is packed between the movable parts of the tilting system may prevent the tilting movement, which, in turn, may lead to unfavourable wheel unload and uncomfortable ride. Without taking special measures such snow packing in the tilting system will result in great control errors and forces.

SUMMARY OF THE INVENTION

The invention relates to a solution to the above-mentioned problems and other problems associated therewith and is characterized in that the tilting of the car body is adapted to be limited to a maximum value and that in the case of snow, packed between the different parts of the tilting system, the degree of snow packing is indicated and that, when a certain degree of snow packing is exceeded, the desired value of the tilting movement is maximized to a suitable smaller value. Forces and control errors have here been utilized in order to indicate the occurrence of snow packing as well as to indicate the degree of snow packing and thereby minimize the risk of wheel unload and other drawbacks. By indicating when the quantity exceeds an expected threshold value and then measuring the current tilt angle, a measure of the degree of snow packing is obtained. By adapting the maximum limit of the desired value and hence the tilt angle immediately after indication, so that the indication ceases, the risk of wheel unload is minimized while at the same time the passenger comfort is enhanced.

In the case of snow packing, differences in tilt angle between the actual tilt value of the bolster beams relative to the respective bogie will also arise. As an indication of snow packing, control errors, forces and the difference in tilt value can therefore be used.

BRIEF DESCRIPTION OF THE DRAWINGS

The invention is exemplified in the accompanying drawings, wherein.

DETAILED DESCRIPTION OF THE PREFERRED EMBODIMENT

Figure 3:
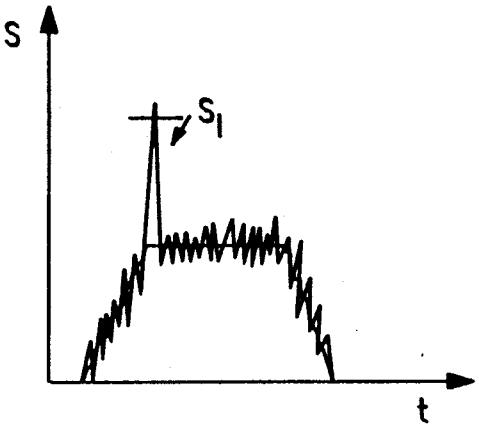
FIG. 3 shows the corresponding relation with snow packing but where measures are taken according to the present invention, FIG. 4 schematically depicts a tilting system for railway cars, FIG. 5 schematically depicts a tilting system in accordance with the present invention.
Figure 2:
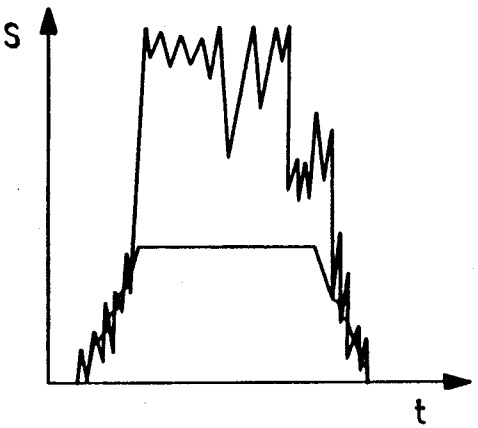
FIG. 2 shows the corresponding relation when negotiating a curve where snow packing occurs, without taking any measures.
Figure 1:
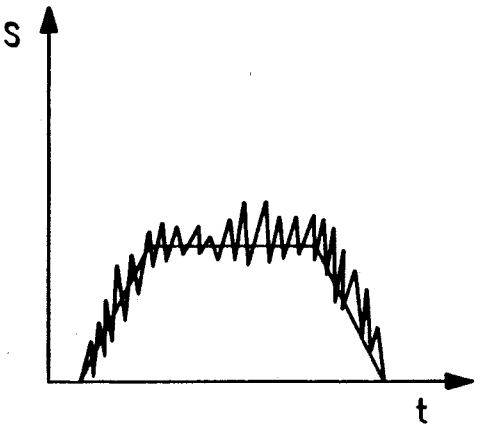
FIG. 1 shows the relation between, for example, force and time when negotiating a normal curve, i.e. without snow problems.

FIG. 1 thus shows the relation in the case of normal running. On comparison with FIG. 2, without taking any measure the force S would reach an unsuitably high value. However, by taking certain measures according to this invention, the force is limited, as shown by the arrow in FIG. 3, since the tilt angle also limits the force.

The differential pressure across the hydraulic cylinders or the measured control error can be used as an indication signal for snow packing. In a railbound vehicle according to the invention, where the hydraulic cylinders are arranged mutually communicating and where the tilting of the car body is adapted to be controlled by a servo function comprising one servo function per vehicle and one rotatable bolster beam per bogie, the difference between the tilt value of the bolster beams relative to the respective bogie may be utilized as an indicating signal.

Figure 4:
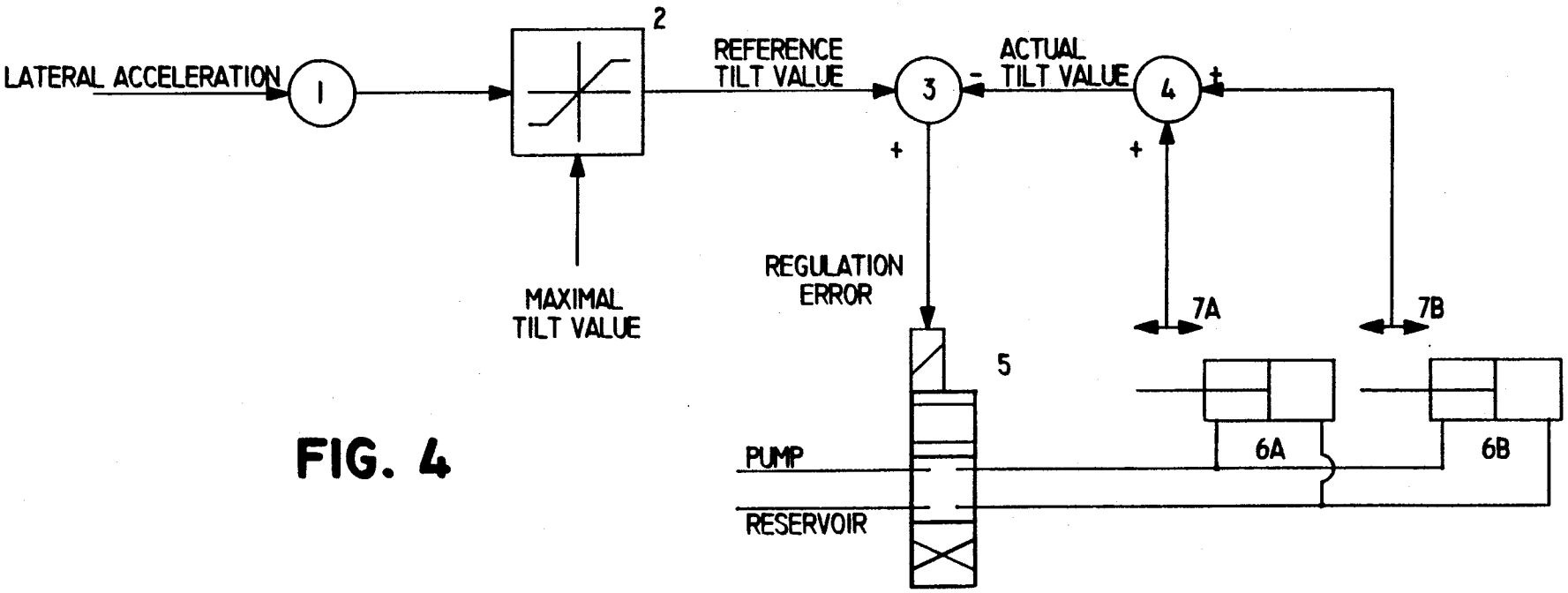

A block diagram of a tilt control system is shown in FIG. 4. The lateral acceleration of the railway car is measured by a lateral accelerometer 1. The output signal from the accelerometer 1 is sent to a limiter 2, which limits the signal to a value corresponding to the maximum tilt value. The difference between the output signal from the limiter 2 (reference value) and the signal corresponding to the actual tilt value is calculated by a first summator 3. The resultant difference signal is normally called "regulation error" and may be used as an input signal to an electrohydraulic valve 5. The oil flow from the electrohydraulic valve 5 controls the movement of the actuator/actuators, in FIG. 4 represented by the actuators 6A and 6B. The position of the actuator/actuators 6A, 6B is measured by at least one position sensor, in the figure represented by position sensors 7A and 7B.

The mean value of the signals from the position sensors 7A, 7B is calculated by a second summator 4 and the resulting information signal is returned as "actual tilt value" to the first summator 3.

Figure 5:
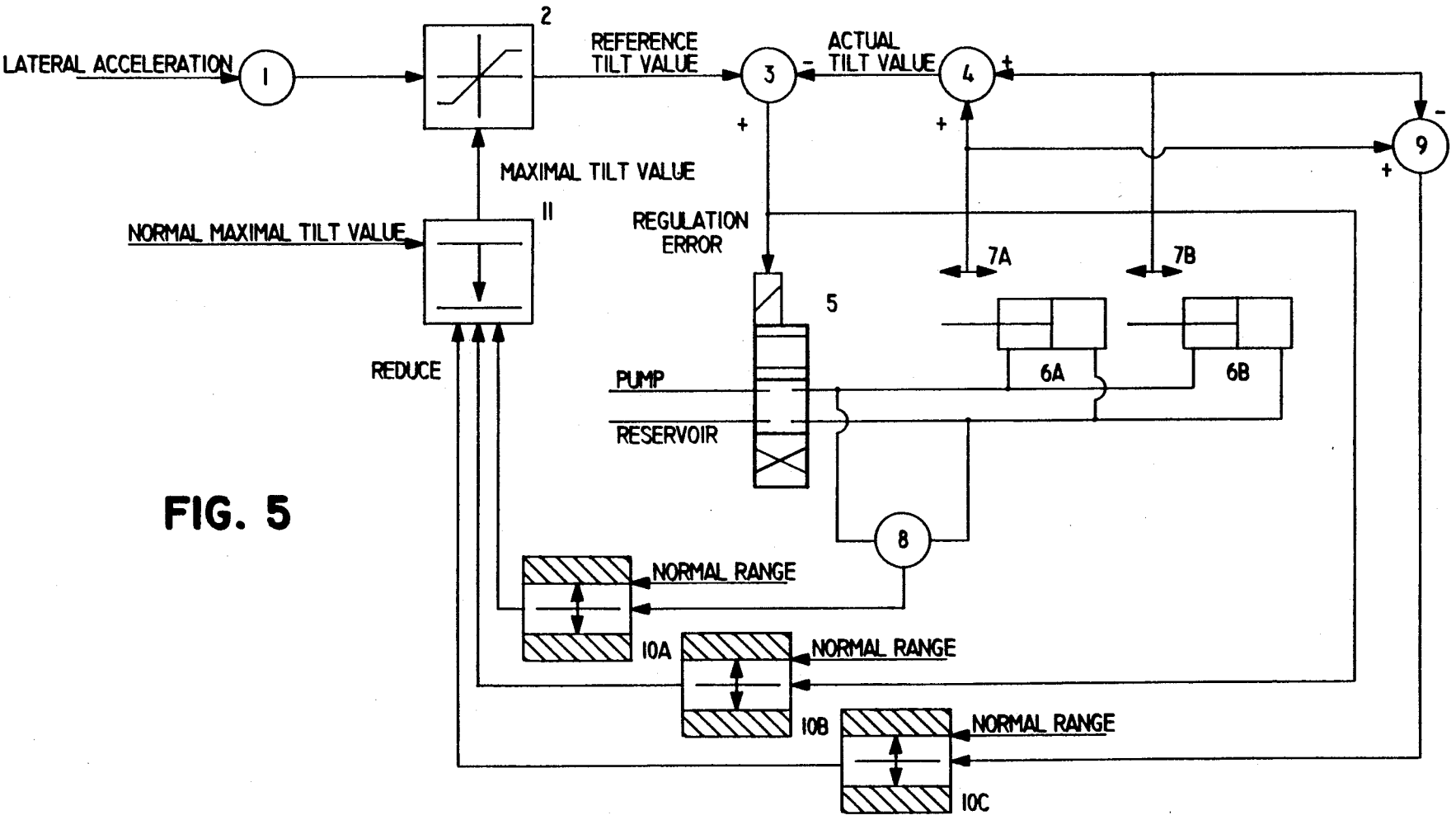
Figure 6:
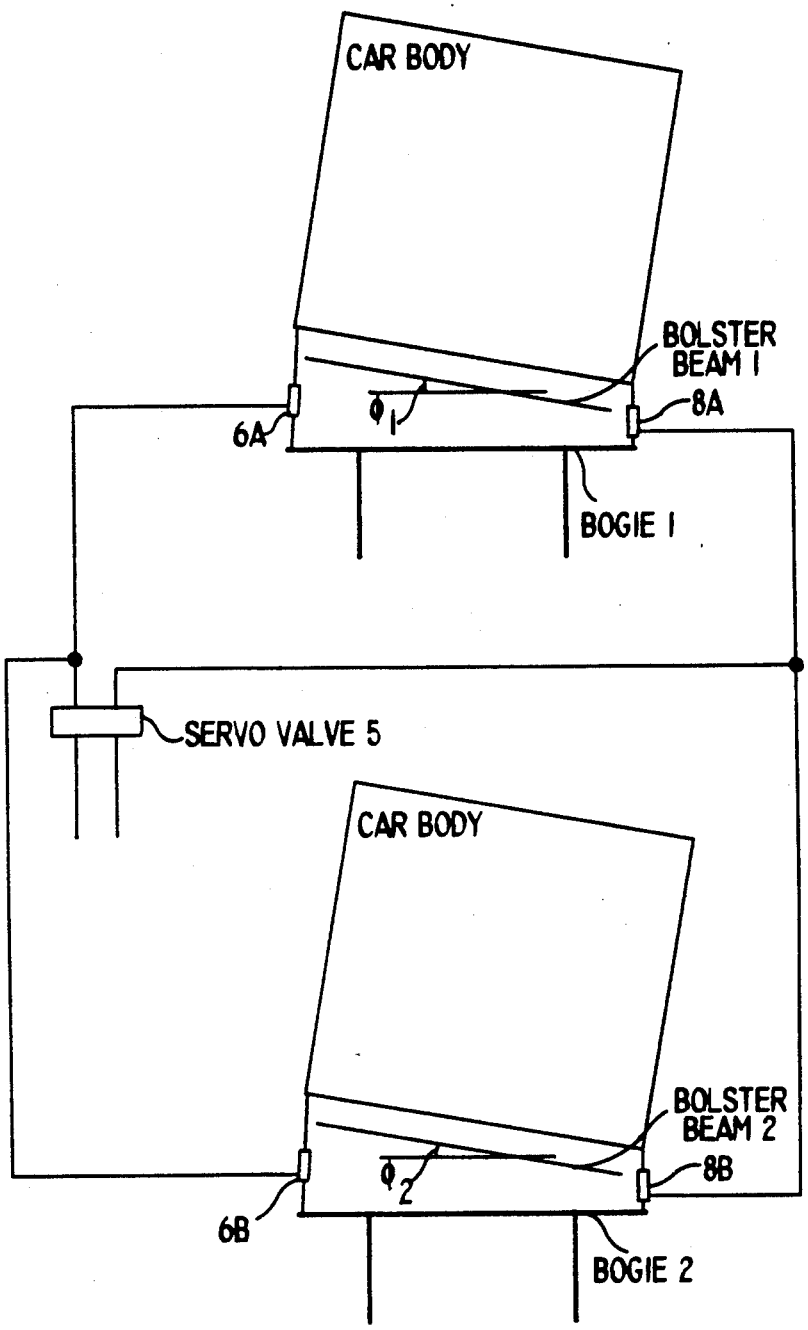
FIG. 6 depicts an embodiment of the present invention wherein the inventive method is used in conjunction with a vehicle having two bogies supporting the car body, the hydraulic cylinders connected to the body above the bogies mutually communicating with each other and controlled by one servo value, and wherein the indication signal is derived from a difference between the tilt values $\phi_1$ and $\phi_2$ of the bolster beams of the two bogies resulting from snow packing.

The method according to the invention is attained by the means provided and shown in FIG. 5, where a block diagram of a tilt system with snow packing indication is shown. The difference between the system shown in FIG. 5 and the tilt control system in FIG. 4 is that the maximum tilt value is variable and controlled by one or more of three possible information sources, which are adapted to generate the above-mentioned indication signal, in the tilt control system. Source A is the differential oil pressure over the actuators, measured by a transducer 8. Source B is the regulation error, an already existing information in the tilt control system. Source C is the difference in position between the actuators 6A, 6B. This latter source C is only possible to use if the actuators 6A, 6B are arranged mutually communicating and the car body tilt is adapted to be controlled by a servo function comprising only one servo valve per vehicle. The difference in position is calculated by a third summator 9 as the difference in signal from the position sensors 7A, 7B. The signal from a source A, B, and C is sent to a comparator 10A, 10B and 10C, respectively, which compares the signal corresponding to the normal maximum and minimum tilt values. Order to the reducer 11 to reduce the maximum tilt value is given as long as one of the signals from the comparators 10A, 10B and 10C indicates that one information source has a value out of the normal range, which indicates that, for example, snow packing is a fact.

The invention can be varied in many ways within the scope of the following claims.

We claim:

1. A method for tilting the car body of a railbound vehicle in a track curve, the railbound vehicle comprising at least a first and a second bogie and at least one hydraulic cylinder mounted at each bogie and at least one servo valve controlling the position of said hydraulic cylinders, thus controlling the tilt value of the car body, the method comprising the steps of:

measuring the lateral acceleration of the car body;

setting a maximum tilt value for the car body;

forming a reference tilt value signal in a limiter in dependence on at least the measured lateral acceleration and the set maximum tilt value;

measuring the position of each hydraulic cylinder and forming an actual tilt value signal;

comparing the reference tilt value signal with the actual tilt value signal;

forming a regulation error signal which controls the servo valve, which by adjusting the hydraulic cylinders accommodates the tilt such that the actual tilt value equals the reference tilt value;

indicating the degree of snow packing on the vehicle by at least one indication signal, in the case of snow affecting the tilting of the car body;

setting a normal range of the indication signal as the range within which the indication signal lies when no snow packing occurs; and forming a new reduced maximum tilt value such that the normal range of the indication signal is resumed if the normal range of the indication signal is exceeded in the case of snow packing.

2. A method for tilting the car body according to claim 1, wherein said indication signal corresponds to a differential pressure arising across the hydraulic cylinders of the vehicle as a result of snow packing.

3. A method for tilting the car body according to claim 1, wherein said indication signal corresponds to the measured regulation error signal as a result of snow packing.

4. A method for tilting the car body according to claim 1, where all hydraulic cylinders of the vehicle mutually communicate such that the car body tilt is controlled by only one servo valve per vehicle and one turnable bolster beam per bogie, and wherein said indication signal corresponds to the difference between the tilt values of the bolster beam relative to the respective bogie as a result of snow packing.

* * * * *